US011567437B2

(12) United States Patent
Lee

(10) Patent No.: US 11,567,437 B2
(45) Date of Patent: Jan. 31, 2023

(54) PHOTO FINISHER WITH DUCT APART FROM BELT

(71) Applicant: HEWLETT-PACKARD DEVELOPMENT COMPANY, L.P., Spring, TX (US)

(72) Inventor: Seung-Jun Lee, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/254,176

(22) PCT Filed: Jun. 14, 2019

(86) PCT No.: PCT/US2019/037316
§ 371 (c)(1),
(2) Date: Dec. 18, 2020

(87) PCT Pub. No.: WO2020/096649
PCT Pub. Date: May 14, 2020

(65) Prior Publication Data

US 2021/0271194 A1 Sep. 2, 2021

(30) Foreign Application Priority Data

Nov. 7, 2018 (KR) ..... 10-2018-0135881

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
CPC ..... G03G 15/2017; G03G 15/2021; G03G 15/2053; G03G 15/6573; G03G 21/206
See application file for complete search history.

(56) References Cited

U.S. PATENT DOCUMENTS

| | | | | |
|---|---|---|---|---|
| 6,026,274 | A | 2/2000 | Aslam et al. | |
| 7,024,149 | B2 | 4/2006 | Kito et al. | |
| 8,306,446 | B2 | 11/2012 | Ito et al. | |
| 8,909,088 | B2 | 12/2014 | Murooka | |
| 2007/0196119 | A1* | 8/2007 | Fujita | G03G 15/2039 399/68 |

(Continued)

FOREIGN PATENT DOCUMENTS

| | | |
|---|---|---|
| JP | 05046050 | 2/1993 |
| JP | 2004020801 A | 1/2004 |
| JP | 2006213491 A | 8/2006 |

(Continued)

*Primary Examiner* — Thomas S Giampaolo, II
(74) *Attorney, Agent, or Firm* — Foley & Lardner LLP

(57) ABSTRACT

A photo finisher includes a heating roller, a pressing roller, a belt, a supporting roller and a duct. The heating roller is to generate heat. The pressing roller is pressed against the heating roller to form a heating nip. The belt is supported by the supporting roller and the heating roller to pass through the heating nip, and the belt is extending to a downstream side of the heating nip. The duct is positioned apart from the belt, the duct includes a first end in the width direction being provided with an air inlet port and a second end, opposite to the first end, being blocked, and the duct includes an air discharge port opening towards the belt.

11 Claims, 13 Drawing Sheets

(56) References Cited

U.S. PATENT DOCUMENTS

2010/0226681 A1* 9/2010 Okuda ..... G03G 15/2064
399/92

FOREIGN PATENT DOCUMENTS

| | | | |
|---|---|---|---|
| JP | 2008120517 | A | 5/2008 |
| JP | 2009192998 | A | 8/2009 |
| JP | 5664614 | B2 | 2/2015 |
| JP | 5962192 | B2 | 8/2016 |
| KR | 20070079824 | A | 8/2007 |
| WO | WO-2005101135 | A1 | 10/2005 |

* cited by examiner

PHOTO FINISHER WITH DUCT APART FROM BELT

BACKGROUND

An electrophotographic image forming apparatus irradiates light on a photoconductor charged to have a uniform electric potential to form an electrostatic latent image and supplies a toner to the electrostatic latent image to form a toner image on the photoconductor. The toner image is transferred through an intermediate transfer belt or directly to a print medium. The toner image transferred to the print medium is attached on the print medium by electrostatic force. The fuser applies heat and pressure to the toner image to fix the image permanently to the print medium.

DETAILED DESCRIPTION

A photo finisher is an apparatus which applies heat and pressure to an image fixed on a print medium or an image before being fixed on the print medium, thereby melting the image, such that an image having high gloss is formed on the print medium after rapid cooling.

A method in which a cooling structure contacts with the belt may cause continuous friction between the belt and the cooling structure. For example, the friction between the cooling structure and the belt may cause skewing of the belt. The skewing of the belt may cause friction between a width guide member (not shown) and both ends of the belt, the width guide member guiding both ends of the belt in the width direction. As a result, the belt may be damaged. To obtain a printed image having a substantially uniform glossiness, a contact state between the belt and the cooling structure should be substantially uniform. To this end, strong tension is applied to the belt to maintain the belt substantially flat against the cooling structure. The strong tension may have a negative effect on the wear and skewing of the belt. To maintain a cooling performance while reducing contact resistance between the cooling structure and the belt, a method of arranging a heat conductive paste between the belt and the cooling structure may be considered. However, in this case, the printed image may be contaminated by the heat conductive paste and the belt and components driving the belt may be contaminated, resulting in a slip of the belt.

According to the present example, a non-contact air-cooled type cooling structure in which the duct, which is a cooling structure, is apart from the belt is adopted. Therefore, the friction between the belt and the cooling structure described above may be prevented. Further, since the cooling structure is not in contact with the belt, an assembly of the photo finisher is simplified, and a manufacturing cost may be reduced.

Figure 1:
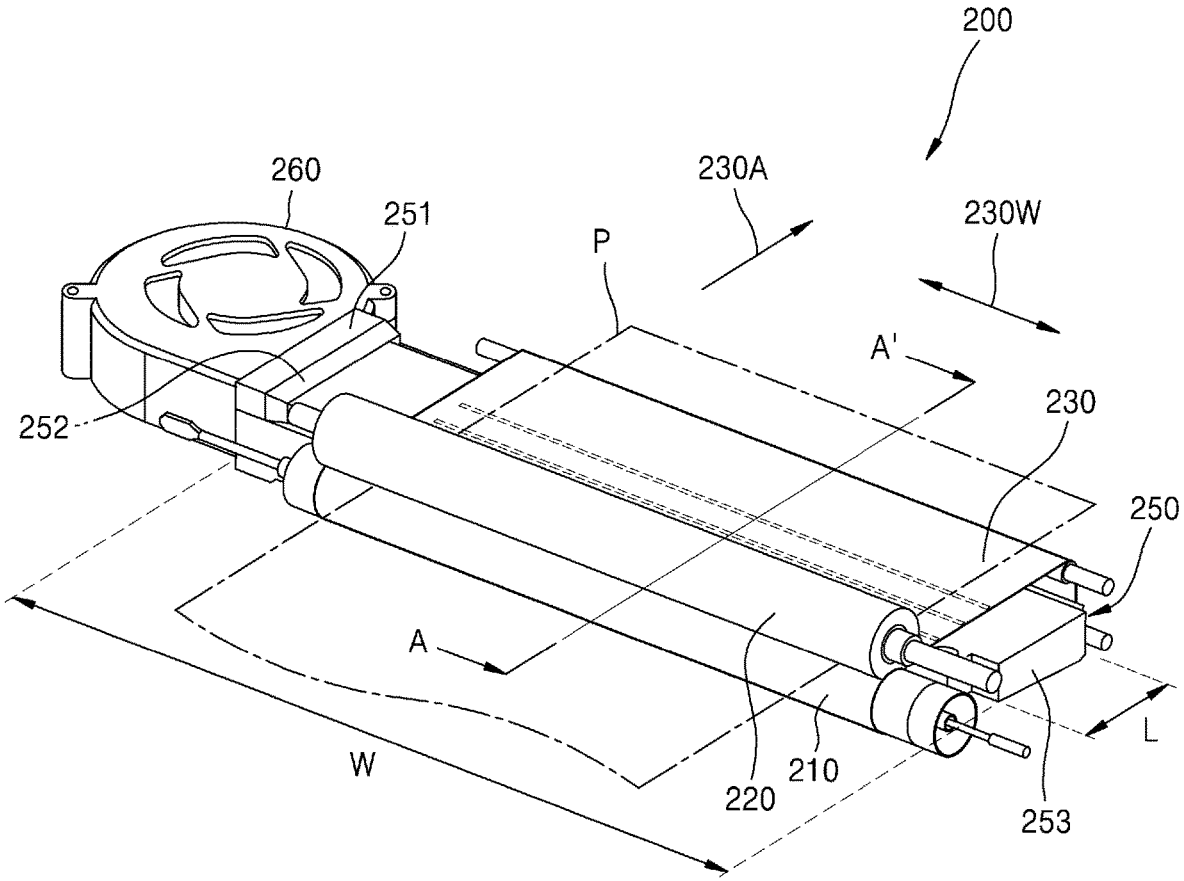
FIG. 1 is a schematic perspective view of an example of a photo finisher.
Figure 2:
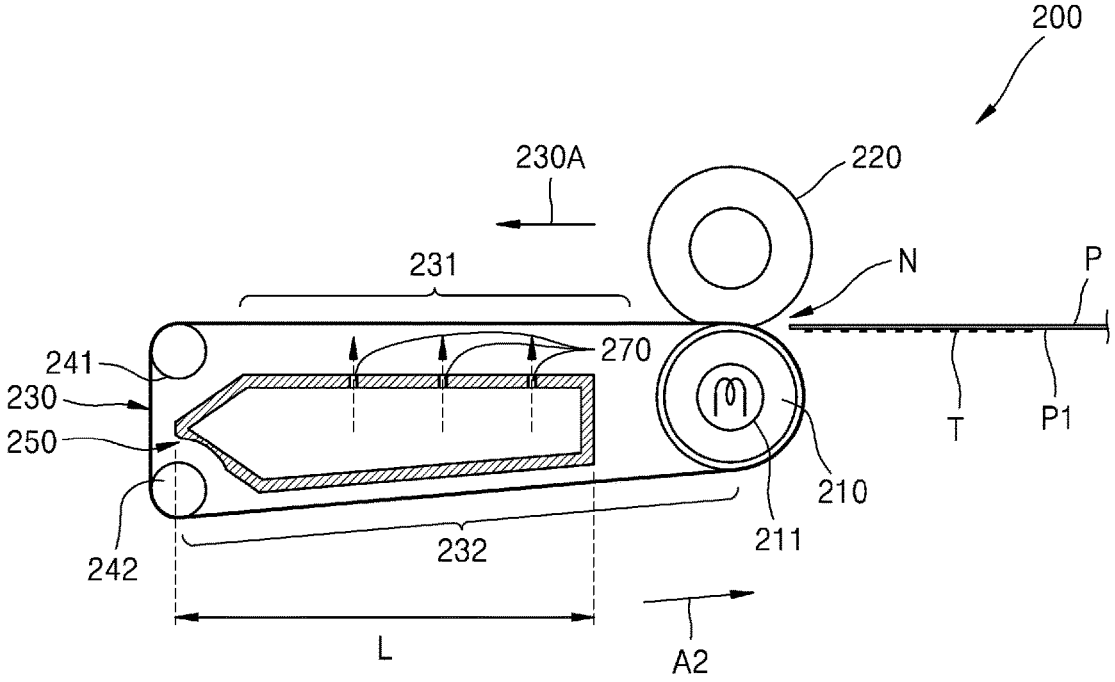
FIG. 2 is a cross-sectional view taken along line A-A' in FIG. 1.

FIG. 1 is a schematic perspective view of an example of a photo finisher 200. FIG. 2 is a cross-sectional view taken along a line A-A' in FIG. 1. Referring to FIG. 1, the photo finisher 200 may include a heating roller 210, a pressing roller 220, a belt 230, a duct 250. The duct 250 is provided with an air discharge port 270 opened towards the belt 230.

The heating roller 210 generates heat. In the prevalent structure, the heating roller opposes an image surface of a print medium P and applies heat to a toner image T fixed on the image surface or held on the image surface by electrostatic force. To this end, the heating roller 210 is heated by a heat source 211. For example, a halogen lamp, an exothermic resistance coil, an induction heater, or a ceramic heater may be used as the heat source 211. A release layer (not shown) may be provided on a surface of the heating roller 210 to improve a separability of a toner image T.

The pressing roller 220 is pressed against the heating roller 210 to form a heating nip N through which the print medium P passes. The pressing roller 220 forms the heating nip N with the heating roller 210 and the belt 230 is placed between the pressing roller 220 and the heating roller 210. The pressing roller 220 presses the print medium P passing through the heating nip N to bring an image surface P1 on which a toner image T is formed into be very close to the belt 230. An elastic layer (not shown) may be provided on an outer periphery of the belt 230 to form a stable heating nip N.

The belt 230 is supported on the heating roller 210 to pass through the heating nip N and extends to a downstream side of the heating nip N to support the print medium P. In this disclosure, the term "downstream side" indicates a running direction of the belt 230 and the term "upstream side" indicates a direction opposite to the running direction of the belt 230. The photo finisher 200 may include supporting rollers 241 and 242 supporting and running the belt 230 together with the heating roller 210. The belt 230 is supported and continuously run by the heating roller 210 and the supporting rollers 241 and 242 and the print medium P is supported by the belt 230 after passing through the heating nip N. A first section 231 is extended to the downstream side of the heating nip N in a running direction of the belt 230, for example, a moving direction of the print medium P, and a second section 232 is extended to an upstream side of the heating nip N from the first section 231. In the example of FIG. 2, the first section 231 is defined by the heating roller 210 and the supporting roller 241, and a second section 232 is defined by the supporting roller 242 and the heating roller 210. The supporting roller 241 may be a tension roller positioned to be apart from the heating roller 210 in the running direction 230A of the belt 230, for example, in the moving direction of the print medium P. The first section 230 may be a section between the heating roller 210 and the supporting roller 241. The second section 232 may be defined by the supporting roller 242 and the heating roller 210. The belt 230 may include, for example, polyimide, stainless steel, nickel, or the like. The belt 230 may have enough flexibility to be continuously run by the heating roller 210 and the supporting rollers 241 and 242. An outer surface of the belt 230 may be a smooth surface.

The duct 250 is positioned apart from the belt 230. The duct 250 may be positioned apart from the first section 231 of the belt 230. The duct 250 has a length L in the running direction 230A of the belt 230 and a width W in a direction (width direction) 230W perpendicular to the running direction 230A. The duct 250 is a duct of which one end 251 in the width direction 230W is provided with an air inlet port 252 and another end 253 opposite to the end 251 in the width direction 230W is blocked.

The blower 260 supplies air into the duct 250 via the air inlet port 252 in many ways. For example, the blower 260 may be an axial fan and may be a centrifugal blower providing a relatively high and stable static pressure.

The air discharge port 270 is opposed to the first section 231 of the belt 230 such that the air supplied by the blower 260 may effectively cool the image surface P1 of the print medium P. The duct 250 of the present example is an inner duct positioned inside the belt 230. The air discharge port 270 is opposed to an inner surface of the belt 230. The air discharge port 270 may have various configurations such as a slit extending in the width direction 230W, a plurality of holes arranged in the width direction 230W, and a plurality of structures in which the respective slit and holes or a combination thereof is arranged in the running direction 230A of the belt 230, and so forth.

The print medium P on which the toner image T is formed on the image surface P1 is passed through the heating nip N. Hereinafter, for the convenience of explanation, the toner image T is used as a term commonly referred to as a toner image and a printed image, unless otherwise stated.

The image surface P1 of the print medium P is opposed to the outer surface of the belt 230 when passing through the heating nip N. The print medium P is pressed against the outer surface of the belt 230 by a pressing force provided by the pressing roller 220. The toner image T on the image surface P1 of the print medium P is heated and melted by receiving thermal energy provided by the heating roller 210 while passing through the heating nip N. For example, the toner image T may be heated to a glass transition temperature or more. The outer surface of the belt 230 is a smooth surface with very low surface roughness. The toner image T is pressed against the outer surface of the belt 230 by receiving thermal energy and pressure in the heating nip N and a surface roughness of the image surface P1 is lowered When the surface roughness of the image surface P1 is lowered, a ratio of diffuse light among light reflected from the image surface P1 is reduced and a ratio of specular light is increased, thereby, a glossiness of the printed image may be increased.

The print medium passing through the heating nip N is supported on the first section 231 of the belt 230 to face the outer surface of the belt 230. Rapid cooling of the print medium P is effective for improving the glossiness. The air supplied into the duct 250 by the blower 260 is discharged towards the first section 231 of the belt 230 through the air discharge port 270. The print medium P is rapidly cooled by the discharged air and adhesion between the toner image T and the outer surface of the belt 230 may be reduced. When the print medium P reaches an end of the first section 231, for example, the supporting roller 241, the print medium P may be separated from the belt 230 by the rigidity of the print medium P.

As described above, the print medium P on which the toner image T is formed is heated and pressed on the belt 230 and then cooled, the glossiness of the printed image is increased and the same effect as a photographic image may be obtained. In addition, a curl of the print medium P may be improved by reducing thermal stress accumulated in the print medium P.

Figure 3:
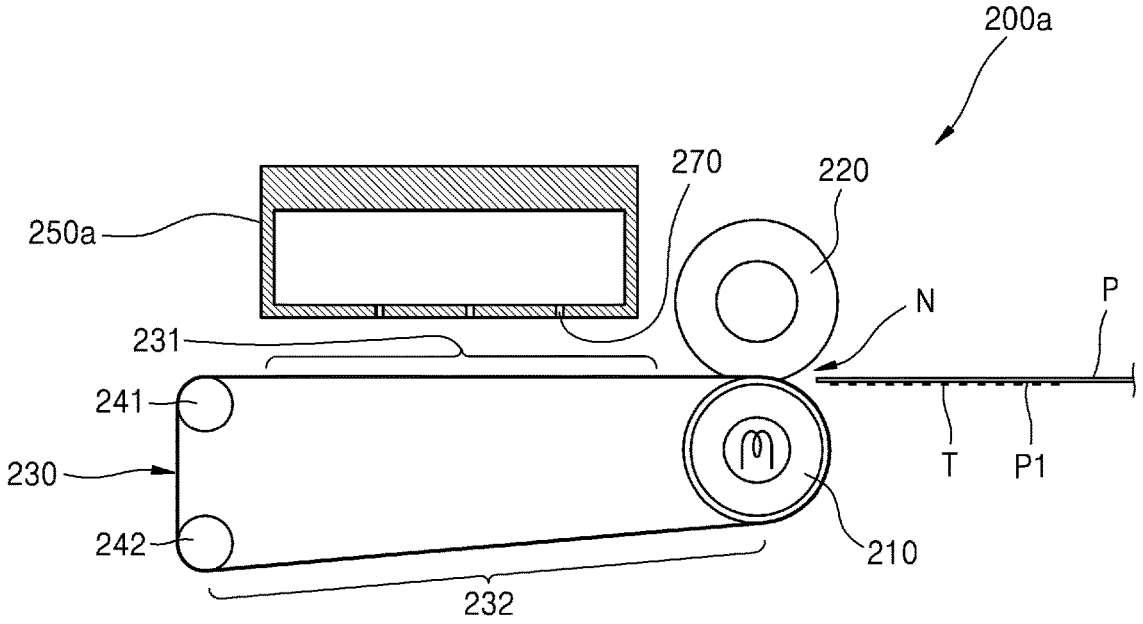
FIG. 3 is a cross-sectional view of an example of a photo finisher.
Figure 4:
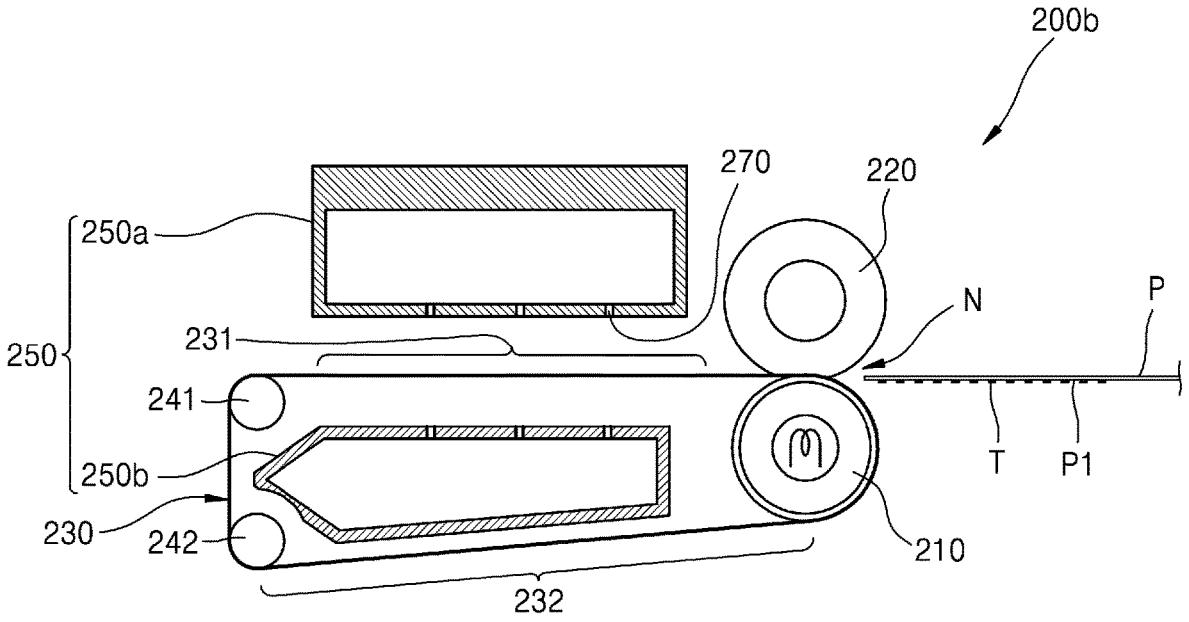
FIG. 4 is a cross-sectional view of an example of a photo finisher.

A position of the duct 250 may be variously arranged. FIG. 3 is a cross-sectional view of an example of a photo finisher 200*a*. FIG. 4 is a cross-sectional view of an example of a photo finisher 200*b*. As shown in FIG. 3, a duct may be an outer duct 250*a* positioned outside the belt 230. The air discharge port 270 outside the belt 230 is opposed to the first section 231 of the belt 230. In addition, as shown in FIG. 4, the duct 250 may include the outer duct 250*a* located outside the belt 230 and an inner duct 250*b* located inside the belt 230. The air discharge ports 270 of the outer duct 250*a* and the inner duct 250*b* are respectively opposed to the first section 231 of the belt 230. In this case, the blower 260 may supply air to the outer duct 250*a* and the inner duct 250*b*. In other case, two blowers may be used to respectively supply air to the outer duct 250*a* and the inner duct 250*b*.

Figure 5:
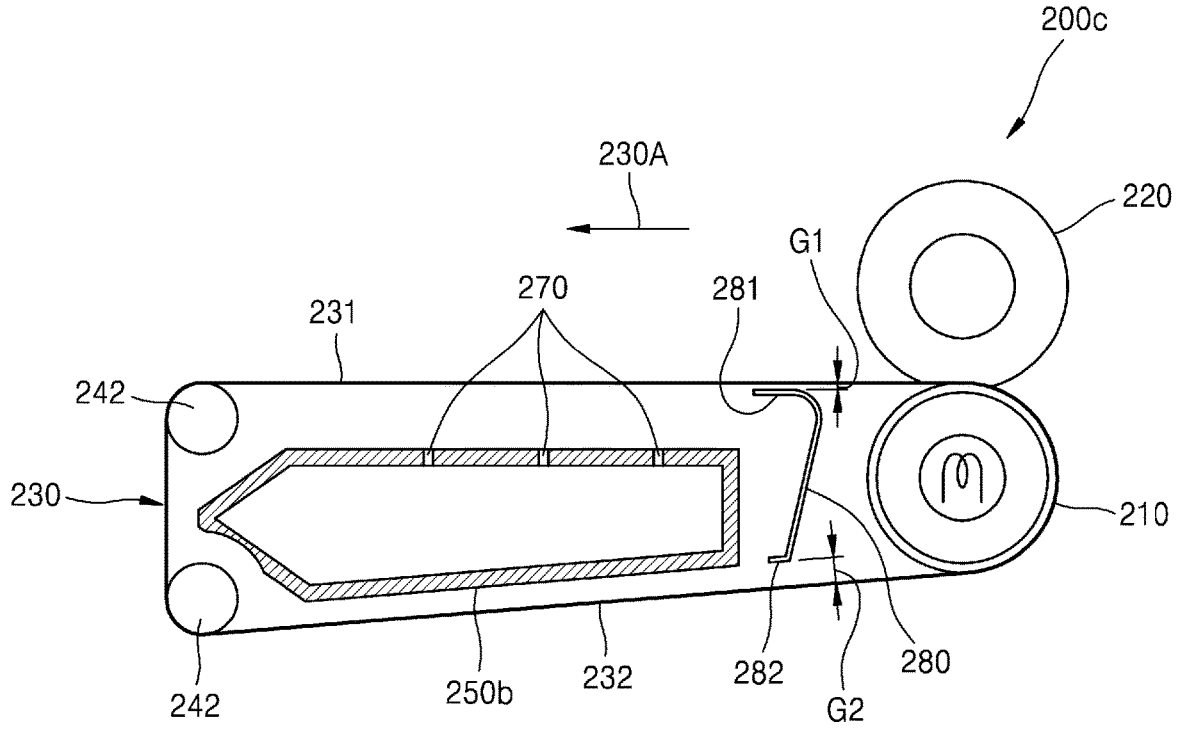
FIG. 5 is a cross-sectional view of an example of a photo finisher.

FIG. 5 is a cross-sectional view of an example of a photo finisher 200*c*. Referring to FIG. 5, the photo finisher 200*c* may include a blocking member 280 positioned between the inner duct 250*b* and the heating roller 210 to block the air discharged through the air discharge port 270 from being directed to the heating roller 210.

In a photo-finishing process, the heating roller 210 should be maintained at a proper temperature. When the heating roller 210 is cooled by the air discharged from the air discharge port 270, power consumption may be increased to maintain the heating roller 210 at the proper temperature. When the air discharged from the air discharge port 270 is transferred to the heating roller 210, the heating roller 210 may be non-uniformly cooled in the width direction 230W, thereby a temperature of the heating roller 210 may be made non-uniform in the width direction 230W. This may cause non-uniformity of the glossiness in the width direction 230W.

A blocking member may be used to block the air discharged through the air discharge port from being directed to the heating roller to prevent the cooling of the heating roller and the increase in power consumption and the non-uniformity of the glossiness due to the cooling of the heating roller. The blocking member may be installed so as not to contact the belt to prevent contact friction with the belt. The blocking member may include a first end and a second end respectively facing the first section and the second section of the belt. In the example of FIG. 5, the blocking member 280 is used to block the air discharged through the air discharge port 270 from being directed to the heating roller 210 to prevent the cooling of the heating roller 210 and the increase in power consumption and the non-uniformity of the glossiness due to the cooling of the heating roller 210.

In addition, when heat generated in the heating roller 210 is transferred to the duct 250 by radiation and convection, an internal temperature of the duct 250 may be increased to cause a decrease in cooling efficiency. The blocking member 280 may also function as a heat blocking member to prevent heat energy of the heating roller 210 from being transferred to the duct 250.

The blocking member 280 may be installed so as not to contact the belt 230 to prevent contact friction with the belt 230. The blocking member 280 may include a first end 281 and a second end 282 respectively facing the first section 231 and the second section 232 of the belt 230. The first end 281 and the second end 282 are located apart from the belt 230. The first end 281 of the blocking member 280 is located closer to the belt 230 than the second end 282 of the blocking member 280 to prevent the air discharged from the air discharge port 270 from flowing towards the heating roller 210 after contacting the first section 231 of the belt 230. That is, a distance G1 between the belt 230 (i.e. the first section 231 of the belt 230) and the first end 281 of the blocking member 280 is less than a distance G2 between the belt 230 (i.e. the second section 232 of the belt 230) and the second end 282 of the blocking member 280.

Position the first end 281 of the blocking member 280 as close as possible to the belt 230 is effective in blocking air. In this case, the first end 281 of the blocking member 280 may be intermittently brought into contact with the belt 230 due to vibration of the belt 230 during the running process. In view of this, the first end 281 of the blocking member 280 may give a shape bent in a direction away from the heating roller 210. With this configuration, the first end 281 of the blocking member 280 extends in a direction same as the running direction 230A of the belt 230. Thus, even when the belt 230 and the first end 281 are in contact, a risk of damaging the belt 230 may be reduced. In addition, an edge of the first end 281 may be post-treated to remove a burr by processes such as hamming, cutting, grinding, or the like to further reduce the risk of damaging the belt 230 by contact with the belt 230.

The blocking member 280 may be in an inclined state from the first end 281 towards the second end 282 in a direction away from to the heating roller 210. With this configuration, the air discharged from the air discharge port 270 and brought into contact with the belt 230 may be effectively guided to a lower side of the duct 250 instead of towards the heating roller 210.

The print medium P could be almost uniformly cooled in the width direction 230W to obtain a substantially uniform glossiness. To this end, the uniform cooling in the width direction 230W depends on uniformity of a flow rate of the air discharged from the air discharge port 270 in the width direction 230W. According to an experiment, the uniformity of the flow rate of the air discharged from the air discharge port 270 depends on a total opening area of the air discharge port 270. According to an experiment, the uniformity of the flow rate of the air discharged from the air discharge port 270 in the width direction 230W may be ensured when the total opening area of the air discharge port 270 is 500 $mm^2$ to 1200 $mm^2$.

Figure 6:
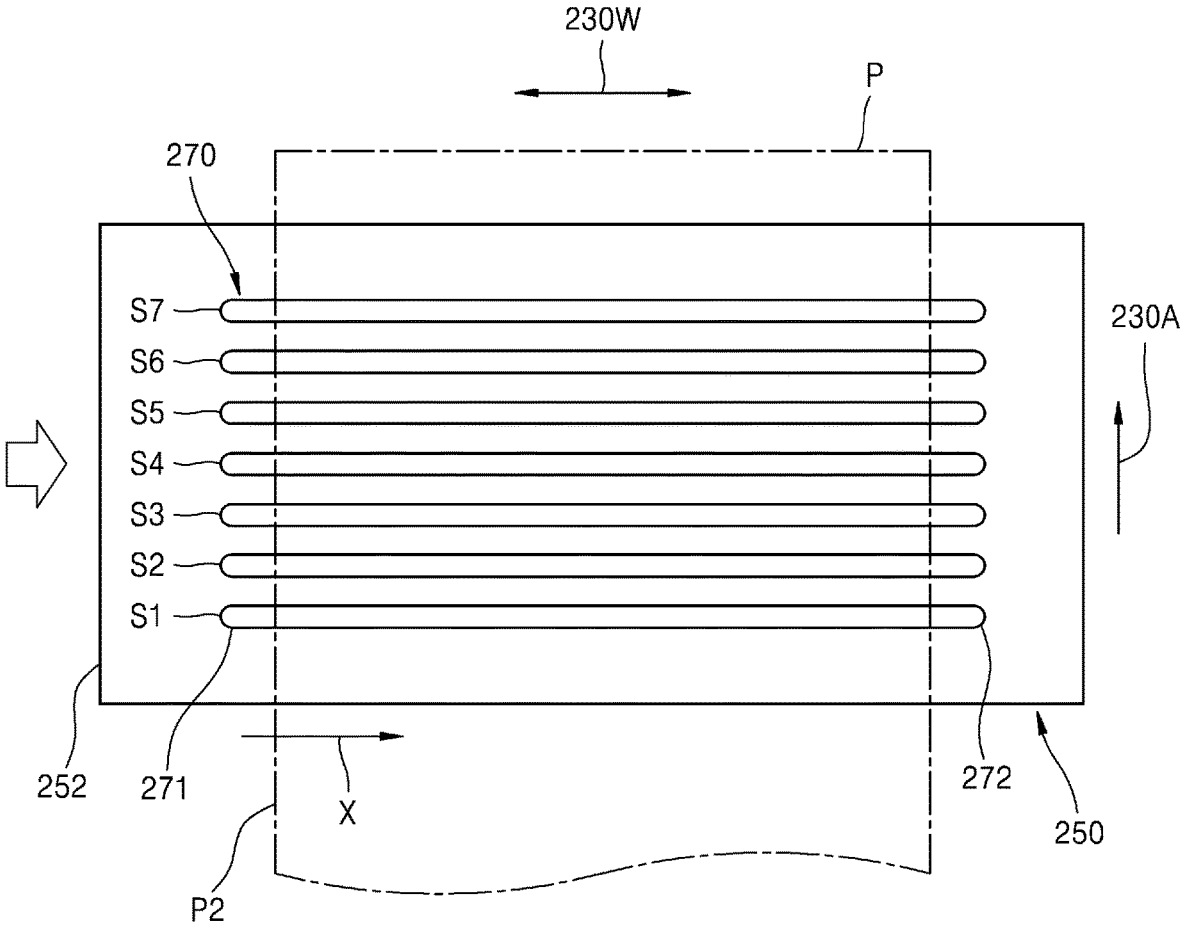
FIG. 6 is an example of a duct.

FIG. 6 is an example of the duct 250 used to identify parameters affecting a discharge flow velocity. Referring to FIG. 6, seven slits S1 to S7 are provided as the air discharge port 270. Air introduced into the duct 250 through the air inlet port 252 is discharged through the slits S1 to S7. A dimension of each of the slits S1 to S7 is 230 mm×1.3 mm. A distance between the slits S1 to S7 is 10 mm.

An axial fan with a static pressure of 0.17 in H2O and a rated flow rate of 56 cubic feet per minute (CFM) was used to measure a discharge rate of air discharged from each slit S1 to S7 at an 8-position along the width direction 230W. The discharge flow velocity of the air was measured at a position 10 mm apart from the air discharge port 270.

Figure 7:
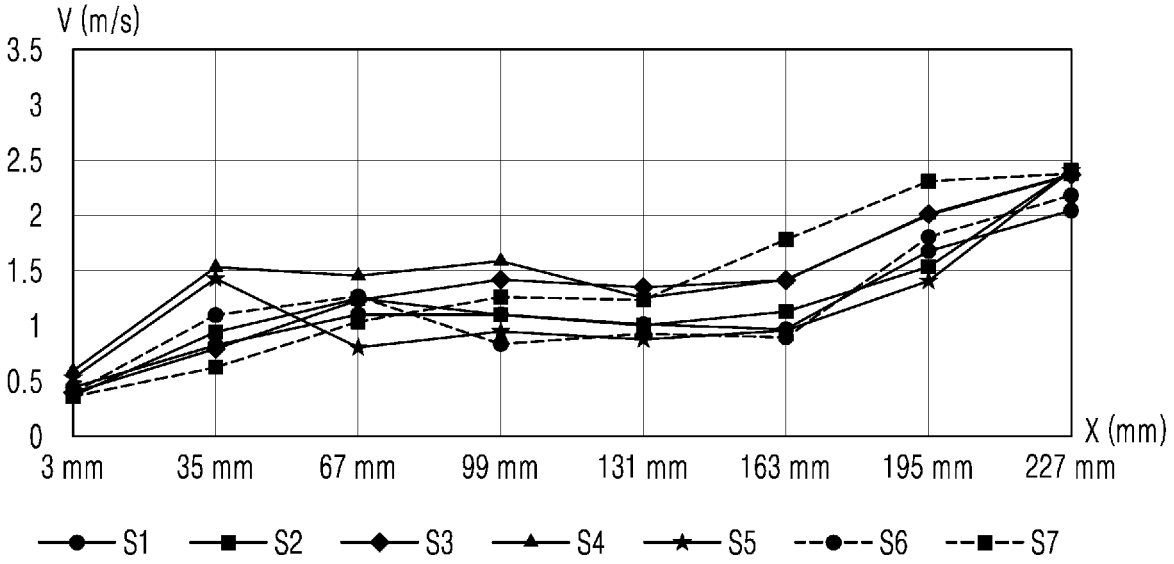
FIG. 7 is a graph showing a result of measuring a discharge flow velocity of air discharged from an air discharge port according to a position in a width direction.

FIG. 7 is a graph showing a result of measuring a discharge flow velocity V of air discharged from the air discharge port 270 according to a position X in a width direction 230W. Referring to FIG. 7, the discharge flow velocity V increases from an upstream side to a downstream side based on the width direction 230W, that is, a flow direction of the air supplied into the duct 250. A reason is that the air tends to be pushed to the downstream side rather than to the air discharge port 270 from the upstream side due to an initial flow rate of the air introduced into the duct 250. The discharge flow velocity varies according to a position of a slit. The discharge flow velocity of the discharged air decreases as the slit and a wall of the duct 250 are closer to each other. A reason is that the flow rate of the air inside the duct 250 at a position near the wall of the duct 250 is lowered due to friction between the air and the wall of the duct 250.

Figure 8A:
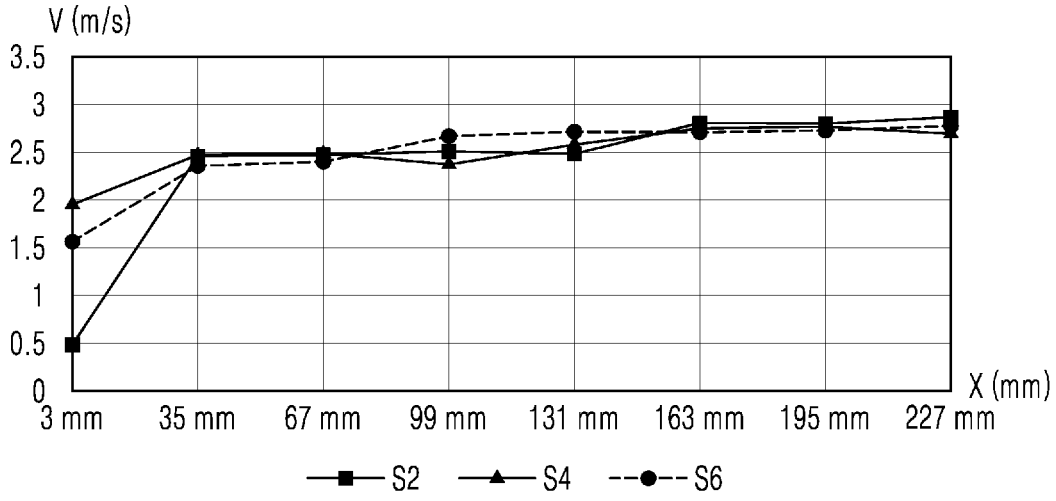
FIGS. 8A and 8B are graphs showing results of measuring a discharge flow velocity of air according to a position in a width direction when 3 slits and one slit are opened.
Figure 8B:
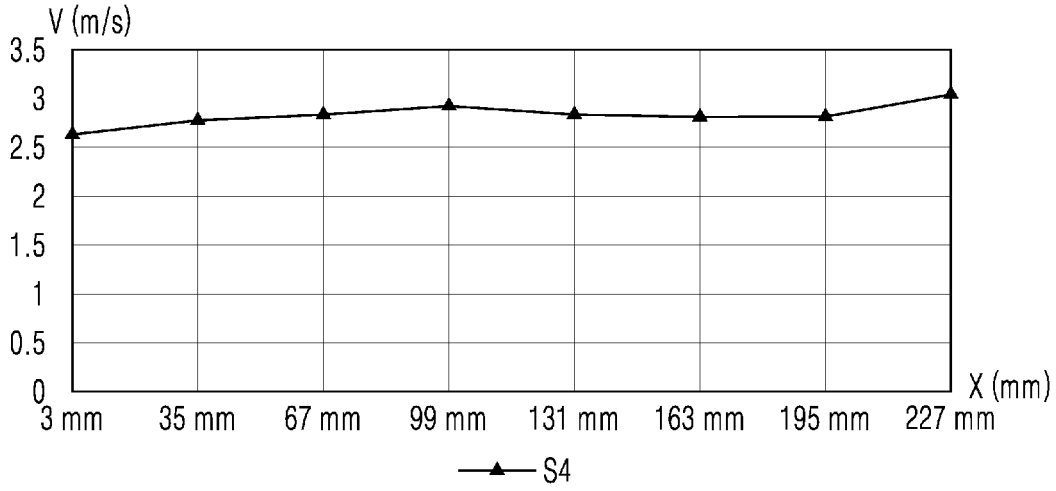

When the discharge flow velocity in the width direction 230W is non-uniform as shown in the graph of FIG. 7, the glossiness of the printed image may become non-uniform. To make the discharge flow velocity in the width direction 230W uniform, the discharge flow velocity was measured while adjusting a number of slits. FIGS. 8A and 8B is graphs showing results of measuring the discharge flow velocity V of air discharged from the air discharge port 270 according to the position X in the width direction 230W when three slits S2, S4, and S6 are opened and one slit S4 is opened. As shown in FIGS. 8A and 8B, a deviation of the discharge flow velocity in the width direction 230W decreases as a number of open slits decreases. A reason is that when an opening area of the air discharge port 270 is reduced to a certain level or less, the air is filled in the duct 250 and an air pressure inside the duct 250 becomes saturated. Therefore, an air distribution inside the duct 250 becomes uniform and the air is discharged through the air discharge port 270 by the static pressure applied by the blower 260. When the air pressure inside the duct 250 is saturated, the deviation of the air flow rate between the upstream side and the downstream side of the duct 250 is lost and a frictional effect with the wall is also lost. Thus, the discharge flow velocity of the air discharged from the air discharge port 270 is made uniform in the width direction 230W.

Next, it has been checked whether the uniformity of the discharge flow velocity in the width direction 230 W described above is influenced by a maximum flow rate or a maximum static pressure of the blower 260. Table 1 shows specifications of the blower 260 used in an experiment. The blowers disclosed in Table 1 are all axial fans.

TABLE 1

| | Maximum flow rate | | Maximum static pressure | | Average discharge flow velocity |
|---|---|---|---|---|---|
| | ($m^3$/min) | CFM | Pa | inH2O | (Three slits open) |
| AX1 | 2.05 | 72.4 | 920 | 3.69 | 4.84 m/s |
| AX2 | 3 | 105.9 | 360 | 1.45 | 4.53 m/s |
| AX3 | 4.32 | 152.6 | 300 | 1.20 | 4.34 m/s |

Figure 9A:
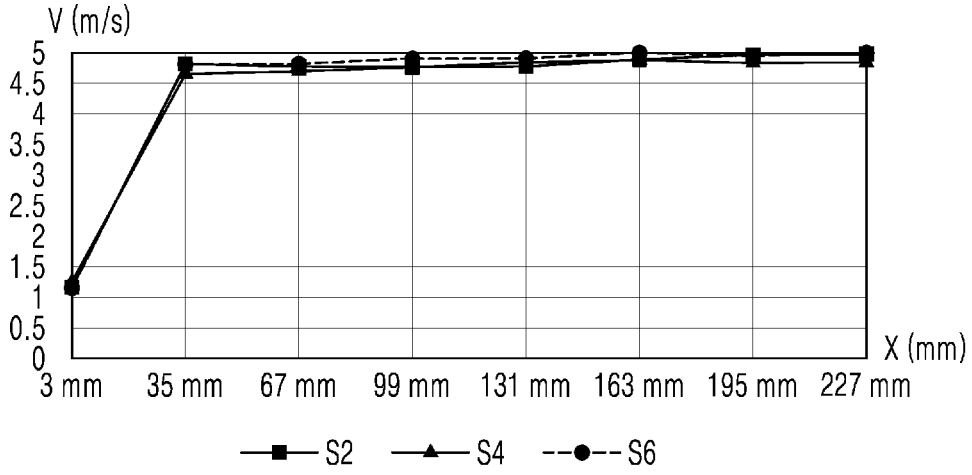
FIGS. 9A, 9B, 9C are graphs showing results of measuring a discharge flow velocity of air according to a position in a width direction, while varying a maximum flow rate of a blower, when 3 silts are opened.
Figure 9B:
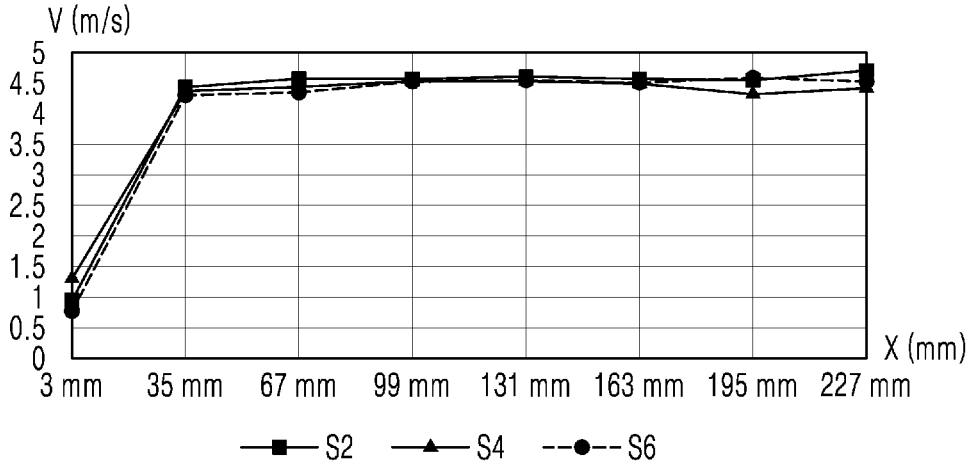
Figure 9C:
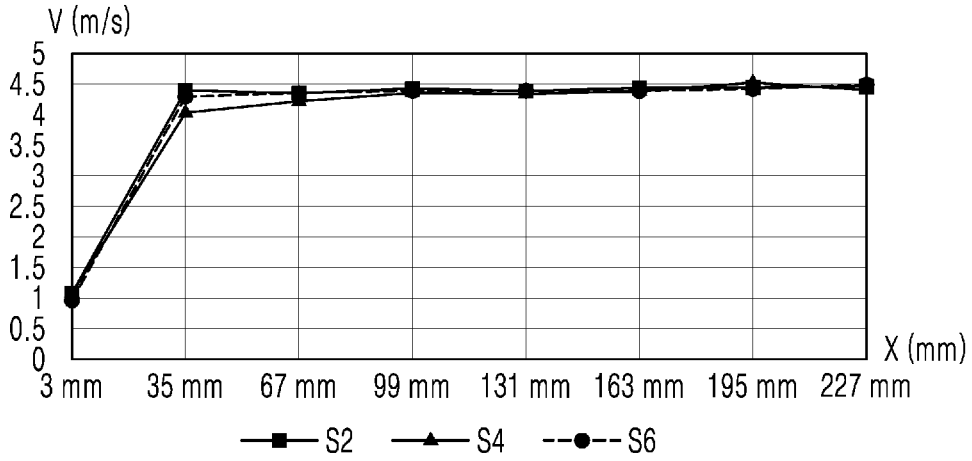
Figure 10A:
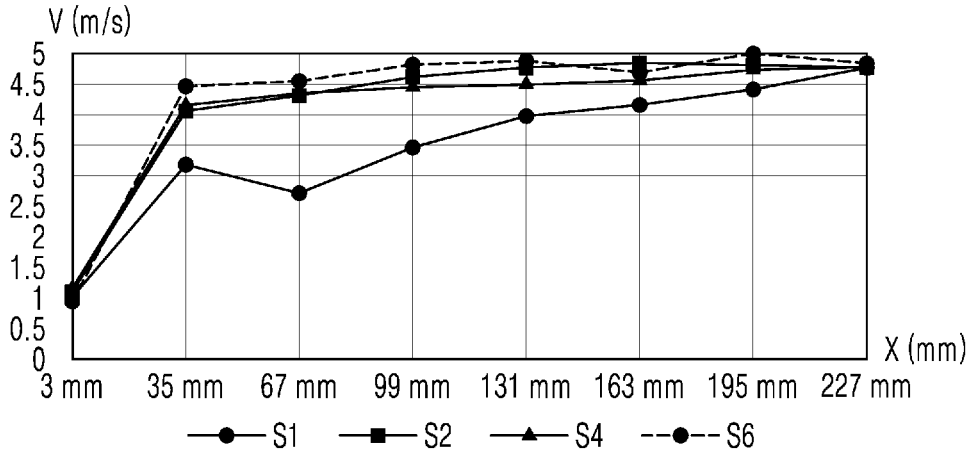
FIGS. 10A, 10B, 10C are graphs showing results of measuring a discharge flow velocity of air according to a number of opened slits while varying a maximum flow rate of a blower, when 4 silts are opened.
Figure 10B:
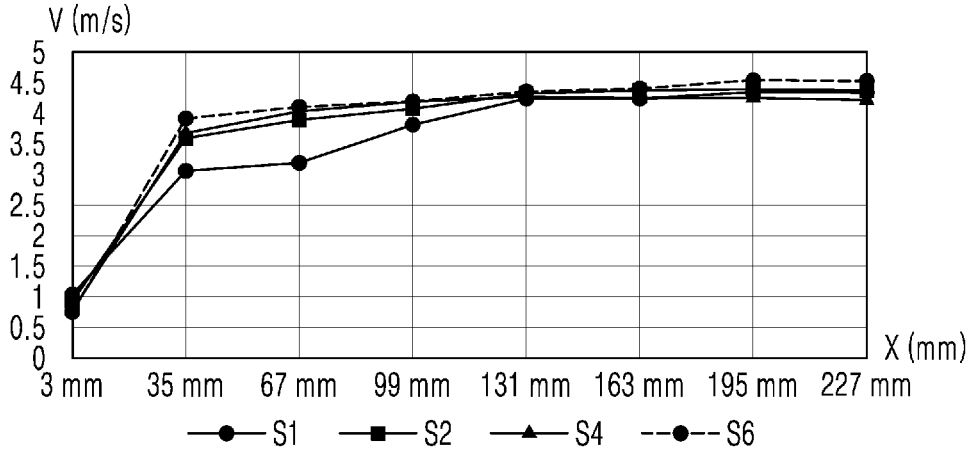
Figure 10C:
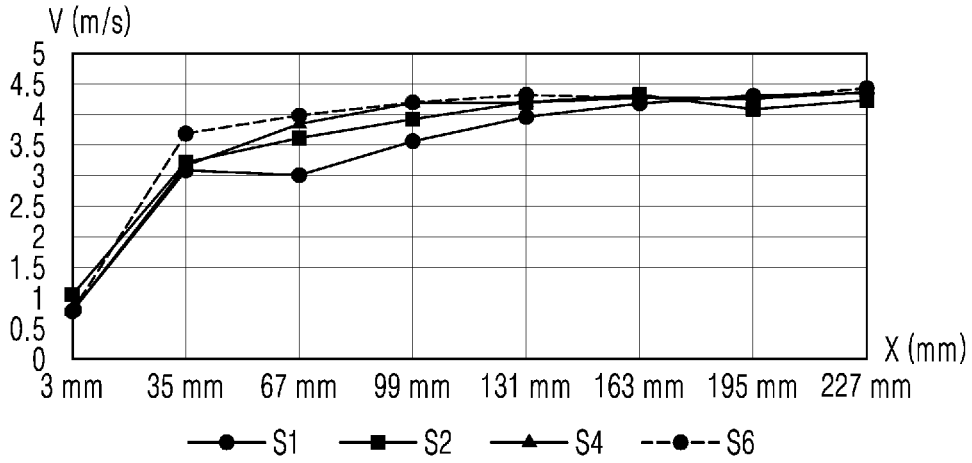

Three blowers in Table 1 were respectively used to measure a distribution of the discharge flow velocities in the width direction 230W in a case where three slits S2, S4, and S6 are opened and in a case where four slits S1, S2, S4, and S6 are opened. FIGS. 9A, 9B, 9C, 10A, 10B, 100 are graphs showing results of measuring the discharge flow velocity V of the air discharged from the air discharge port 270 according to the position X in the width direction 230W while varying the maximum flow rate of a blower, FIGS. 9A, 9B, 9C showing a case where three slits S2, S4, and S6 are opened, and FIGS. 10A, 10B, 100 showing a case where four slits S1, S2, S4, S6 are opened.

Referring to FIGS. 9A, 9B, 9C, 10A, 10B, 10C, irrespective of the specifications of the blower 260, the greater the number of open slits, the greater the deviation between the discharge flow velocity on the upstream side and the downstream side of the duct 250, and the deviation of the discharge flow velocity between a slit near the wall of the duct 250 and a slit far away from the wall of the duct 250 becomes large. Such an experimental result means that the uniformity of the discharge flow velocity in the width direction 230W is determined according to the total opening area of the air discharge port 270, irrespective of the specifications of the blower 260. Also, a level of the discharge flow velocity is proportional to the maximum static pressure of the blower 260, but not the maximum flow rate of the blower 260.

Figure 11A:
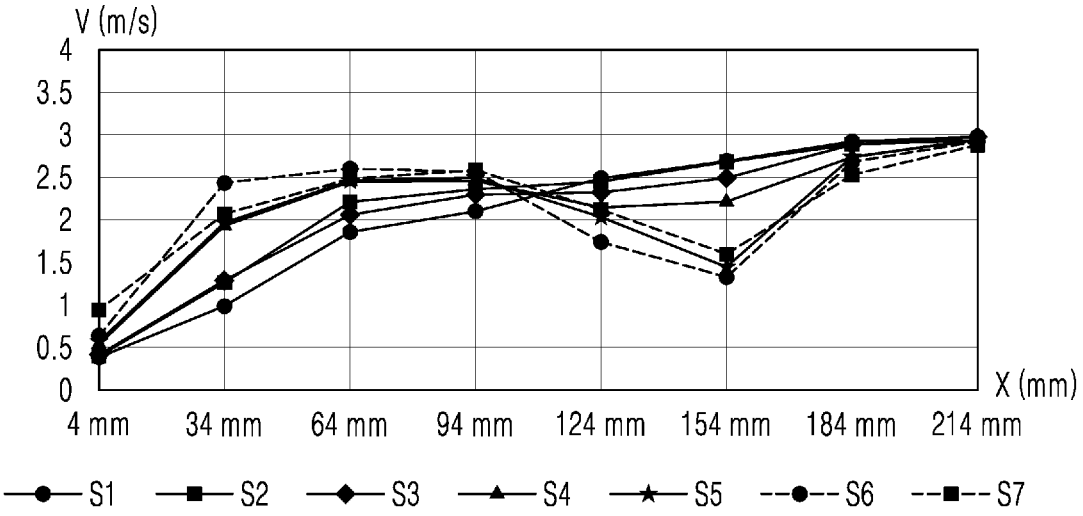
FIGS. 11A and 11B are graphs showing results of measuring a discharge flow velocity of air according to a position in a width direction when a centrifugal blower is used and 7 slits and 4 slits are opened.
Figure 11B:
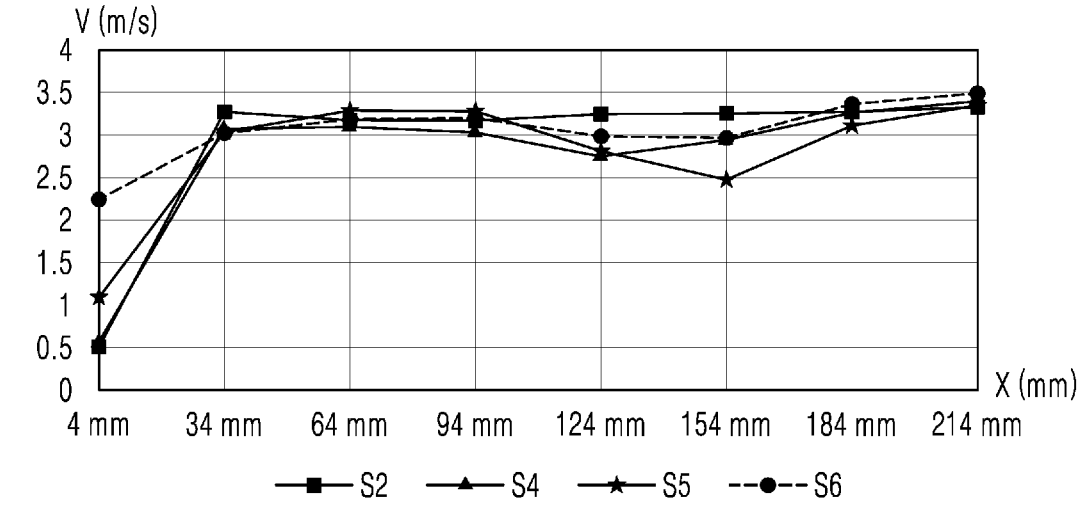
Figure 12A:
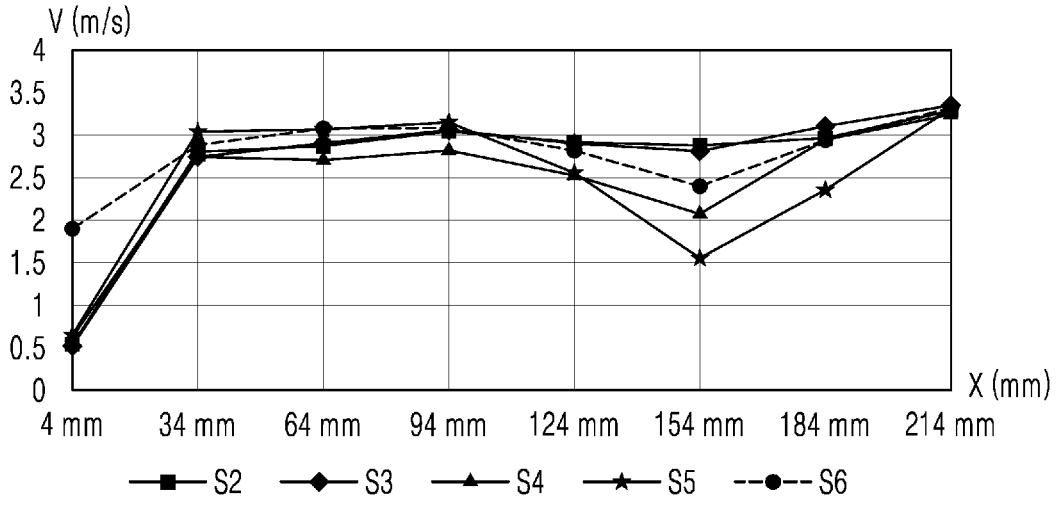
FIGS. 12A and 12B are graphs showing results of measuring a discharge flow velocity of air according to a position in a width direction when a centrifugal blower is used and 5 slits and 3 slits are opened.
Figure 12B:
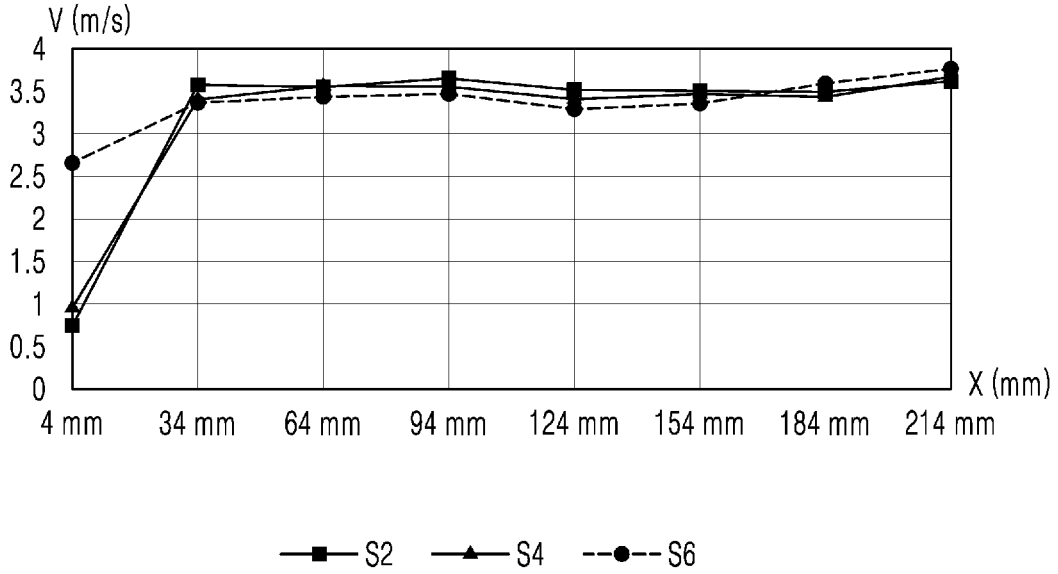

Next, it has been checked whether the uniformity of the discharge flow velocity in the width direction 230W is influenced by a type of the blower 260. The blower 260 used in an experiment is a blower fan (centrifugal blower) with a static pressure of 0.9 in H2O and a maximum flow rate of 24.7 CFM. The measurement is performed in a case where seven slits S1 to S7 are all opened, a case where five slits S2 to S6 are opened, a case where four slits S2, S4, S5, and S6 are opened, and a case where three slits S2, S4, and S6 are opened. FIGS. 11A, 11B, 12A, 12B are graphs showing results of measuring the discharge flow velocity V of the air discharged according to the position X in the width direction 230W while changing a number of opened slits when the centrifugal blower is used, FIGS. 11A, 11B showing a case where seven slits S1 to S7 are opened and a case where four slits S2, S4 to S6 are opened, and FIGS. 12A, 12B showing a case where five slits S2 to S6 are opened and a case where three slits S2, S4, and S6 are opened. Referring to FIGS. 11A, 11B, 12A, 12B, even in the case of the centrifugal blower, a uniform distribution of the discharge flow velocity in the width direction 230W is shown when the number of open slits is reduced to a certain number. In the experimental results, a distribution of the discharge flow velocity is the most uniform when three slits are opened. Uniformity is still available when four slits are opened. When four slits are opened, a total opening area of the air discharge port 270 is $4\times(230\ \text{mm}\times1.3\ \text{mm})=1196\ \text{mm}^2$.

When the total opening area of the air discharge port 270 is reduced, a saturation pressure inside the duct 250 is increased. Then, in a case of the axial fan, the air leaks to a rear side of the blower, and a loss in flow rate and noise may be generated. In a case of the centrifugal blower, the air flows backward and a revolutions per minute of the blower is reduced, resulting in a loss of flow rate and overloading of the blower. In view of this point, a minimum value of the total opening area of the air discharge port 270 may be 500 $\text{mm}^2$ or more.

Therefore, by setting the total opening area of the air discharge port 270 to 500 $\text{mm}^2$ to 1200 $\text{mm}^2$, the loss in the flow rate of the blower 260 is reduced and the blower 260 is not overloaded, and a uniformity of the flow rate of the air discharged from the air discharge port 270 in the width direction 230W may be secured.

Figure 13:
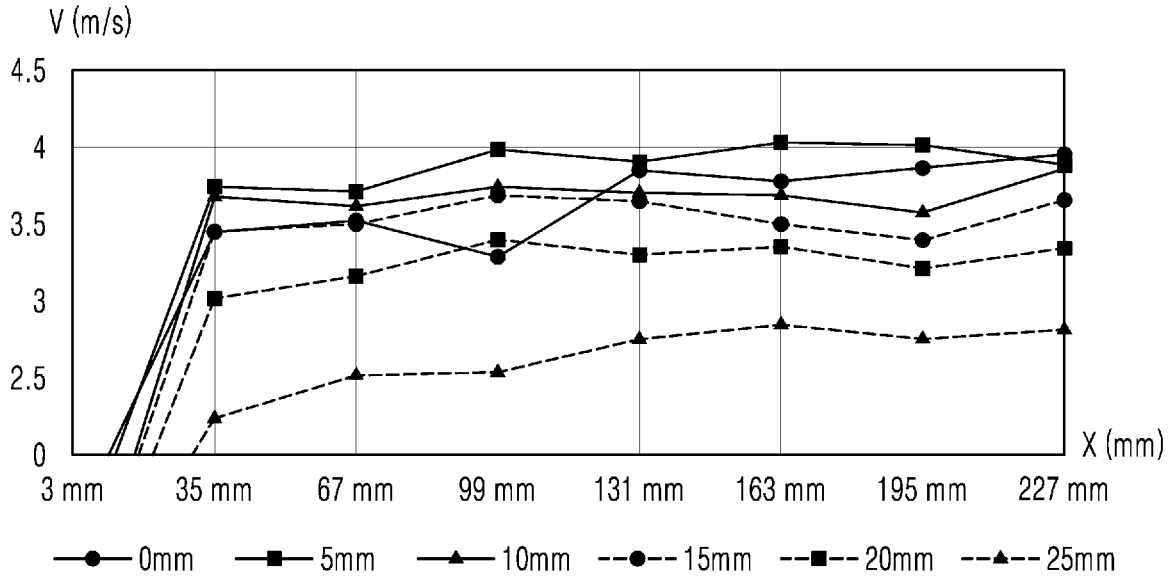
FIG. 13 is a graph showing a relationship between a discharge flow velocity and a distance between an air discharge port and a belt.

FIG. 13 is a graph showing a relationship between a discharge flow velocity and a distance between the air discharge port 270 and the belt 230. Discharge flow velocities in positions away from the air discharge port 270 by 0 mm, 5 mm, 10 mm, 15 mm, 20 mm, and 25 mm are respectively measured. The blower 260 used is a blower fan (centrifugal blower) with a static pressure of 0.9 in H2O and a maximum flow rate of 24.7 CFM. Referring to FIG. 13, as a distance between the air discharge port 270 and the belt 230 reaches about 5 mm, the discharge flow velocity in the width direction 230W becomes uniform. As the distance between the air discharge port 270 and the belt 230 increases, the discharge flow velocity decreases. When the distance between the air discharge port 270 and the belt 230 exceeds about 20 mm, the discharge flow velocity drops sharply. Therefore, in consideration of a level of the discharge flow velocity and uniformity of the discharge flow velocity in the width direction 230W, the distance between the air discharge port 270 and the belt 230 may be about 5 mm to 20 mm.

Also, in the above-described experimental examples, based on an air flow direction inside the duct 250, the discharge flow velocity on the upstream side of the air discharge port 270 is relatively less than that on the downstream side. In view of this point, as shown in FIG. 6, an upstream side end 271 of the air discharge port 270 is located at least outside a corresponding end P2 of the print medium P. A downstream side end 272 of the air discharge port 270 may be located at least outside a corresponding end (an end opposite to the end P2) of the print medium P.

The photo finishers 200, 200*a*, 200*b*, and 200*c* may be used as a stand-alone apparatus. The photo finishers 200, 200*a*, 200*b*, and 200*c* may be in a form of a module capable of being coupled to the image forming apparatus. In addition, the photo finishers 200, 200*a*, 200*b*, and 200*c* may be a portion of the image forming apparatus.

Figure 14:
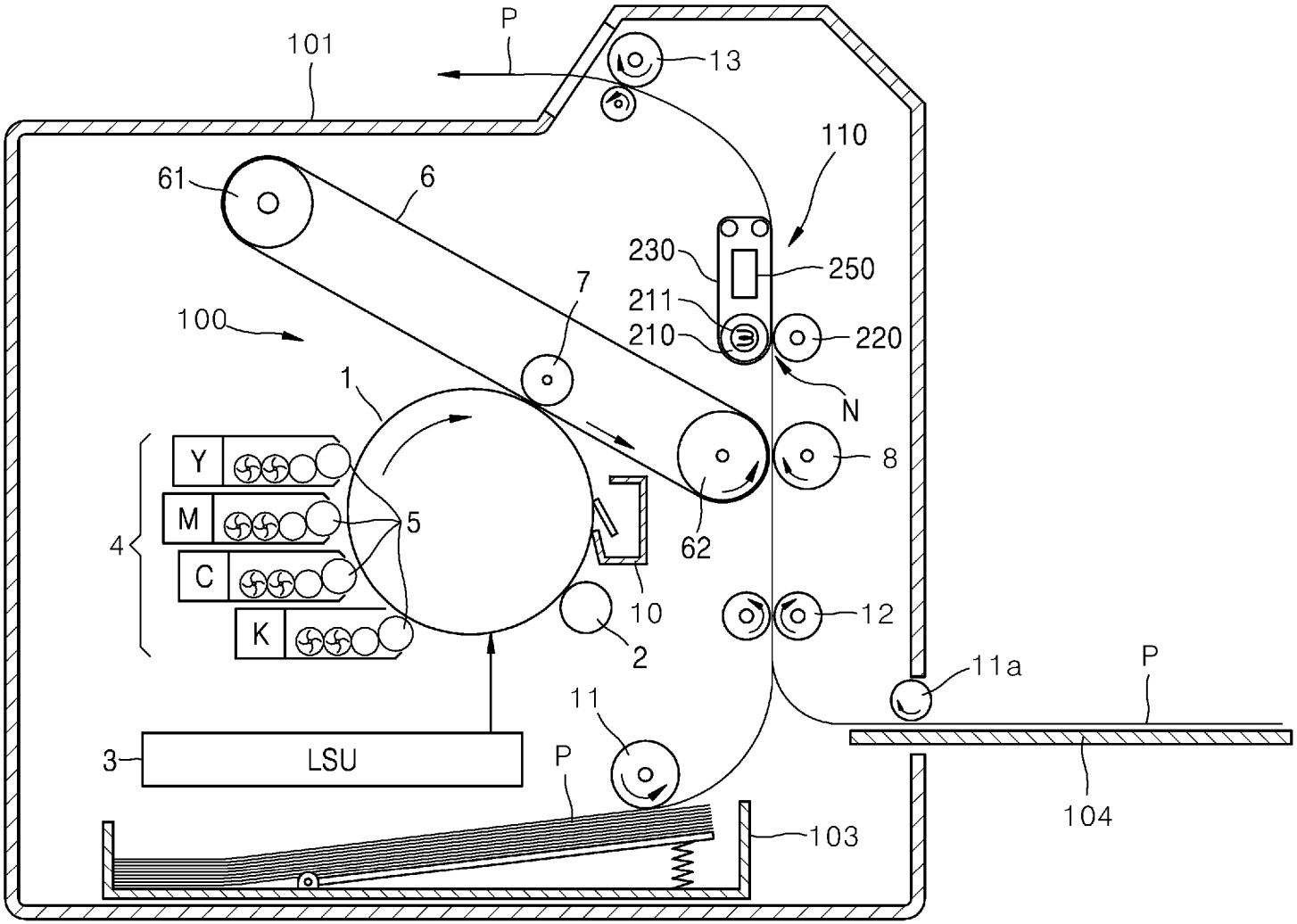
FIG. 14 is a schematic configuration diagram of an example of an image forming apparatus.

FIG. 14 is a schematic configuration diagram of an example of an image forming apparatus. The image forming apparatus of the present example forms an image on the print medium P by a multipass electrophotographic method. Referring to FIG. 14, the image forming apparatus may include a printing unit 100 forming a toner image on the print medium P, and a photo finisher 110 receiving the print medium P from the printing unit 100. The photo finisher 110 may have a structure described in FIGS. 1 to 13. The photo finisher 110 may fix the toner image on the print medium P and improve a glossiness.

In an example, the printing unit 100 may include a photosensitive drum 1, a charging roller 2, an exposure device 3, a developing device 4, an intermediate transfer belt 6, an intermediate transfer roller 7, and a transfer roller 8.

The photosensitive drum 1 is an example of a photoconductor on which an electrostatic latent image is formed, and may include a conductive metal pipe and a photosensitive layer formed on a periphery of the conductive metal pipe. The charging roller 2 is an example of a charger that charges a periphery surface of the photosensitive drum 1 to have a uniform electric potential by supplying electric charge while rotating in a contact state or non-contact state with the peripheral surface of the photosensitive drum 1. A corona discharger (not shown) may be used instead of the charging roller 2. The exposure device 3 forms the electrostatic latent image by radiating light corresponding to image information to the photosensitive drum 1 charged to have a uniform electric potential. A laser scanning unit (LSU) using a laser diode as a light source, and a light emitting diode (LED) exposure device using the LED as a light source may be used as the exposure device 3.

The printing unit 100 of the present example uses toners of colors of cyan C, magenta M, yellow Y, and black K to print a color image. Hereinafter, when each component needs to be distinguished according to color, reference numerals designating the components are respectively indicated by Y, M, C, and K.

The developing device 4 may include four developing devices 4Y, 4M, 4C, and 4K respectively supplying toners of colors of Y, M, C, and K to the electrostatic latent image formed on the photosensitive drum 1 to develop the electrostatic latent image. Each of the developing devices 4Y, 4M, 4C, and 4K includes a developing roller 5. The developing devices 4Y, 4M, 4C, and 4K are located such that the developing roller 5 is apart from the photosensitive drum 1 by a developing gap. The developing gap may be in tens of micrometers to hundreds of micrometers. In a multipass color printer, a plurality of developing devices 4 are sequentially operated. A developing bias voltage is applied to the developing roller 5 of one selected developing device (for example, 4Y) and the developing bias voltage may not be applied or a bias voltage preventing development of the toners may be applied to the developing rollers 5 of the remaining developing devices (for example, 4M, 4C, and 4K). The developing roller 5 of the selected developing device (for example, 4Y) may be rotated and the developing rollers 5 of the remaining developing devices (for example, 4M, 4C, and 4K) may not be rotated.

The intermediate transfer belt 6 is supported by the supporting rollers 61 and 62 and travels at a circumferential speed equal to a circumferential speed of the photosensitive drum 1. A length of the intermediate transfer belt 6 may be equal to or greater than a length of the print medium P of a maximum size used in the image forming apparatus. The intermediate transfer roller 7 faces the photosensitive drum 1 and an intermediate transfer bias voltage transferring a developed toner image on the photosensitive drum 1 to the intermediate transfer belt 6 is applied to the intermediate transfer roller 7. The transfer roller 8 is installed to face the intermediate transfer belt 6. The transfer roller 8 is apart from the intermediate transfer belt 6 while the toner image is being transferred from the photosensitive drum 1 to the intermediate transfer belt 6. When the toner image is completely transferred to the intermediate transfer belt 6, the transfer roller 8 is brought into contact with the intermediate transfer belt 6 by a certain pressure. A transfer bias voltage transferring the toner image to the print medium P is applied to the transfer roller 8. A cleaning member 10 removes a toner remaining on the photosensitive drum 1 after the transfer.

An image forming process with such a configuration will be briefly described.

Light corresponding to image information of, for example, a color of yellow Y from the exposure device 3 is irradiated to the photosensitive drum 1 charged by the charging roller 2 to have a uniform electric potential. An electrostatic latent image corresponding to an image of a color of yellow Y is formed on the photosensitive drum 1. A developing bias voltage is applied to the developing roller 5 of the yellow developing device 4Y. Then, a toner of yellow Y color is attached to the electrostatic latent image and a toner image of yellow Y color is developed on the photosensitive drum 1. The toner image of yellow Y color is transferred to the intermediate transfer belt 6 by an intermediate transfer bias voltage applied to the intermediate transfer roller 7. When the transfer of the toner image of one page of yellow Y color is completed, the exposure device 3 irradiates light corresponding to image formation of, for example. magenta M color, onto the photosensitive drum 1 charged by the charging roller 2 to have a uniform electric potential, thereby forming an electrostatic latent image corresponding to an image of magenta M color. The magenta developing device 4M supplies a toner of magenta M color to the electrostatic latent image to develop the electrostatic latent image. When the toner image of magenta M color is formed on the photosensitive drum 1 is transferred to the intermediate transfer belt 6 to be overlapped on the firstly transferred yellow Y toner image. The above-described process is also performed with respect to colors of cyan C and black K, a color toner image in which toner images of colors of yellow Y, magenta M, cyan C, and black K are overlapped is formed on the intermediate transfer belt 6.

The transfer roller 8 is in contact with the intermediate transfer belt 6. A pick-up roller 11 or 11*a* picks up the print medium P from a paper feed cassette 103 (or a multipurpose tray 104). A transporting roller 12 transports the print medium P to a transfer nip where the intermediate transfer belt 6 faces the transfer roller 8. The color toner image is transferred to the print medium P passing through the transfer nip by a transfer bias voltage.

When the print medium P passes through the heating nip N of the photo finisher 110, the color toner image is fixed on the print medium P by heat and pressure, and at the same time, is pressed against a surface of the belt 230. When the print medium P is cooled by the air discharged from the air discharge port 270 of the duct 250, a glossiness of the fixed color toner image is increased and the same effect as a photographic image may be obtained. The thermal stress accumulated in the print medium P may be reduced to improve the curl of the print medium P. The print medium P on which the printing has been completed is discharged to a discharge tray 101 by a discharge roller 13.

Figure 15:
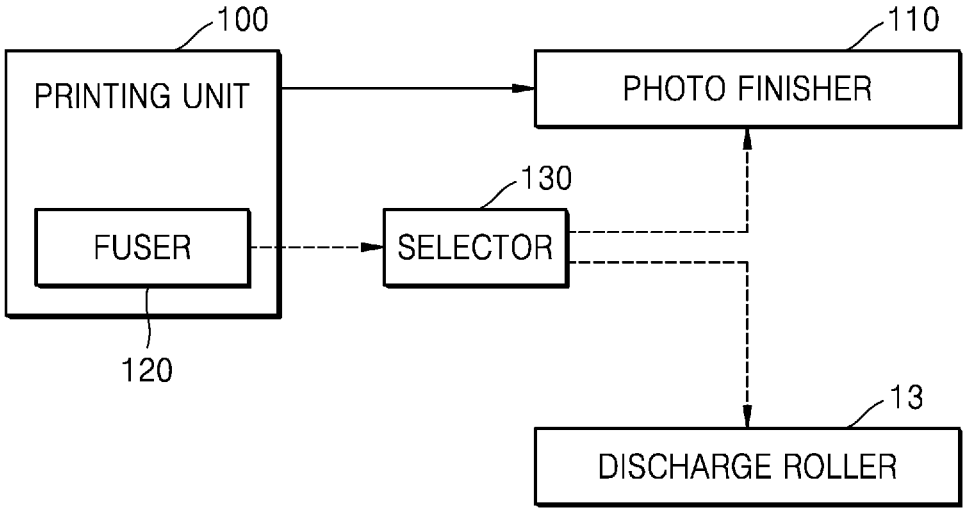
FIG. 15 is a block diagram of an example of an image forming apparatus.

FIG. 15 is a block diagram of an example of an image forming apparatus. Referring to FIG. 15, a structure of the printing unit 100 is the same as that shown in FIG. 14, but differs in that the printing unit 100 has a fuser 120 fixing the toner image on the print medium P. The fuser 120 may have a variety of known configurations. Although not illustrated in drawings, for example, the fuser 120 may include a heating roller and a pressing roller which are pressed against each other to form a fusing nip. The heating roller may be heated by a heater.

When the print medium P on which the toner image is formed passes through the fusing nip, the toner image is melted by heat and fixed on the print medium P by the pressure. The photo finisher 110 receives the print medium P from the fuser 120. The photo finisher 110 heats and melts the toner image printed on the print medium P and presses the toner image on the belt 230. The print medium P is cooled by using the air discharged from the air discharge port 270 of the duct 250 to increase a glossiness of the toner image, and a same effect as a photographic image may be obtained. The thermal stress accumulated in the print medium P may be solved to improve the curl of the print medium P.

The print medium P discharged from the fuser 120 may be discharged by the discharge roller 13. The image forming apparatus may include a selector 130 selectively guiding the print medium P discharged from the fuser 120 to the photo finisher 110 or the discharge roller 13. The photo finisher 110 may be modularly coupled to the image forming apparatus, or may be integrated with the image forming apparatus.

While the present disclosure has been described with reference to the examples shown in the drawings, it is illustrative. While the disclosure has been particularly shown and described with reference to examples thereof, it will be understood by those skilled in the art that various changes in form and details may be made therein without departing from the spirit and scope of the inventive concept as defined by the appended claims.

What is claimed is:

1. A photo finisher comprising:

a heating roller to generate heat, a pressing roller pressed against the heating roller to form a heating nip, a belt supported by a support roller and the heating roller to pass through the heating nip, the belt extending to a downstream side of the heating nip, a duct positioned apart from the belt and inside the belt, the duct including a first end in a width direction being provided with an air inlet port and a second end, opposite to the first end, being blocked, and the duct including an air discharge port opening towards the belt, and a blocking member between the duct and the heating roller to block air discharged through the air discharge port from being directed to the heating roller, wherein a distance between a first end of the blocking member and a first section of the belt facing the first end of the blocking member is less than a distance between a second end of the blocking member and a second section of the belt facing the second end of the blocking member.

2. The photo finisher of claim 1, wherein the first section of the belt is defined by a downstream side from the heating roller to the supporting roller, and the second section of the belt is defined by an upstream side from the supporting roller to the heating roller, and the air discharge port faces the first section.

3. The photo finisher of claim 2, wherein a distance between the air discharge port and the first section of the belt is between 5 mm to 20 mm.

4. The photo finisher of claim 1, wherein the first end of the blocking member is bent in a direction away from the heating roller.

5. The photo finisher of claim 1, wherein the blocking member is inclined from the first end of the blocking member towards the second end of the blocking member in a direction away from the heating roller.

6. The photo finisher of claim 1, wherein a total opening area of the air discharge port is between 500 $mm^2$ to 1200 $mm^2$.

7. An image forming apparatus comprising:

a printing unit to form a toner image on a print medium, and the photo finisher of claim 1, wherein the photo finisher is to receive the print medium discharged from the printing unit.

8. The image forming apparatus of claim 7, wherein the printing unit comprises a fuser to fix the toner image on the print medium.

9. A photo finisher comprising:

a belt, a heating roller to support the belt with a support roller, the heating roller is to generate heat, a pressing roller to form a heating nip with the heating roller with the belt being between the pressing roller and the heating roller, a duct inside the belt on a downstream side of the heating nip, the duct including a first end in a width direction being provided with an air inlet port and a second end, opposite to the first end, being blocked, and the duct including an air discharge port opening towards the belt passing through the heating nip, and a blocking member between the duct and the heating roller to block air discharged through the air discharge port from being directed to the heating roller, wherein a distance between a first end of the blocking member and a first section of the belt facing the first end of the blocking member is less than a distance between a second end of the blocking member and a second section of the belt facing the second end of the blocking member.

10. The photo finisher of claim 9, wherein a total opening area of the air discharge port is between 500 $mm^2$ to 1200 $mm^2$.

11. The photo finisher of claim 10, wherein a distance between the air discharge port and the belt passing through the heating nip is between 5 mm to 20 mm.

* * * * *